US010994972B2

(12) United States Patent
Falconer

(10) Patent No.: US 10,994,972 B2
(45) Date of Patent: May 4, 2021

(54) WINCH

(71) Applicants: Charlie Arsenault, Rexton (CA); Kevin Falconer, Cambridge (CA)

(72) Inventor: Kevin Falconer, Cambridge (CA)

( * ) Notice: Subject to any disclaimer, the term of this patent is extended or adjusted under 35 U.S.C. 154(b) by 0 days.

(21) Appl. No.: 16/441,838

(22) Filed: Jun. 14, 2019

(65) Prior Publication Data

US 2020/0391983 A1 Dec. 17, 2020

(51) Int. Cl.
*B66D 1/00* (2006.01)
*B66D 1/02* (2006.01)

(52) U.S. Cl.
CPC ..... *B66D 1/02* (2013.01)

(58) Field of Classification Search
CPC .... B66D 1/50; B66D 1/52; B66D 3/26; B60P 7/0846; B60P 7/0853
USPC ..... 242/378, 378.1, 378.2, 385, 385.3
See application file for complete search history.

(56) References Cited

U.S. PATENT DOCUMENTS 4,060,211 A * 11/1977 Takada ..... B60R 22/44 242/385.3
4,103,845 A * 8/1978 Ueda ..... B60R 22/44 242/385.3
4,349,164 A * 9/1982 Naitoh ..... B60R 22/44 242/383.4
5,581,821 A * 12/1996 Nakano ..... A42B 3/166 128/866
5,655,726 A * 8/1997 Peterson ..... B65H 75/4449 242/378.2
6,007,053 A * 12/1999 Huang ..... B60P 7/083 254/223
6,494,435 B1 * 12/2002 Cauchon ..... B60P 7/083 254/213
7,350,767 B2 * 4/2008 Huang ..... B60P 7/083 24/68 CD
7,789,603 B2 * 9/2010 Huck ..... B60P 7/083 410/100
7,942,360 B2 * 5/2011 Breeden ..... B60D 1/18 242/378.1
8,312,601 B2 * 11/2012 Huang ..... B60P 7/083 24/68 CD
8,905,379 B2 * 12/2014 Huang ..... B65H 75/4457 254/218
8,973,222 B2 * 3/2015 Breeden ..... B60P 7/083 24/68 CD
9,296,330 B2 * 3/2016 Diamond ..... B60P 7/083
9,862,300 B1 * 1/2018 Anderson ..... B60P 7/0846
9,908,454 B1 * 3/2018 Waters, Jr. ..... B60P 7/0846
10,632,895 B2 * 4/2020 Zhou ..... B60P 7/083
2004/0013490 A1 * 1/2004 Cauchon ..... B60P 7/083 410/103

(Continued)

*Primary Examiner* — Emmanuel M Marcelo
(74) *Attorney, Agent, or Firm* — US IP Attorneys, PC.; Timothy Marc Shropshire

(57) ABSTRACT

The present disclosure describes a winch comprising a recoiling mechanism engaged to a winding member having a strap installed on, and wound around, the winding member. By rotating the strap away from the winding member to secure an object to the winch, a coil, which is positioned within the recoiling mechanism, is rotated from an unbiased position at rest to a biased position not at rest. Once the strap is disconnected and a locking gear is disengaged, the coil is naturally rotated back to its original unbiased position at rest, which in turn rotates the winding member and rewinds the strap around it.

1 Claim, 7 Drawing Sheets

(56) References Cited

U.S. PATENT DOCUMENTS

| | | | | |
|---|---|---|---|---|
| 2004/0084558 | A1* | 5/2004 | Huang | B60P 7/0846 242/385.4 |
| 2006/0197071 | A1* | 9/2006 | Huang | B60P 7/083 254/217 |
| 2009/0236458 | A1* | 9/2009 | Rodrique | B65H 54/585 242/374 |
| 2011/0233493 | A1* | 9/2011 | Huang | B60P 7/083 254/250 |
| 2016/0250961 | A1* | 9/2016 | Tolly | B60P 7/0853 410/100 |
| 2016/0347233 | A1* | 12/2016 | Kingery | B60P 7/083 |
| 2019/0135163 | A1* | 5/2019 | Moua | B60P 7/0846 |

* cited by examiner

WINCH

FIELD

The invention relates to the field of winches, and more specifically to a winch with an automatically recoiling system.

SUMMARY

The present disclosure provides a winch comprising a winding member to wind a strap, the winding member having a bracket and terminating in a connector. The winch also has a recoiling mechanism connected to the winding member, the recoiling mechanism further comprising an adapter to operatively engage the connector; and, a coil secured to the adapter and coiled within the recoiling mechanism. The recoiling mechanism, also has a locking gear connected to the winding member to lock the recoiling mechanism when the coil is in a biased position and, a bolt removably secured through the adapter and the connector wherein unwinding the strap from the winding member correspondingly rotates the coil to the biased position when the bolt is secured through the adapter and the connector.

The present disclosure also provides a method of winding a winch comprising the steps of:

- disconnecting a recoiling mechanism containing a coil from a winding member;
- releasing a lock and winding a strap around the winding member;
- reconnecting the recoiling mechanism from the winding member; and,
- re-engaging the lock,
- wherein further rotation of the strap from the winding member correspondingly rotates the coil to a biased position.

BRIEF DESCRIPTION OF THE DRAWINGS

The following figures serve to illustrate various embodiments of features of the disclosure. These figures are illustrative and are not intended to be limiting.

DETAILED DESCRIPTION

The following embodiments are merely illustrative and are not intended to be limiting. It will be appreciated that various modifications and/or alterations to the embodiments described herein may be made without departing from the disclosure and any modifications and/or alterations are within the scope of the contemplated disclosure.

Figure 1:
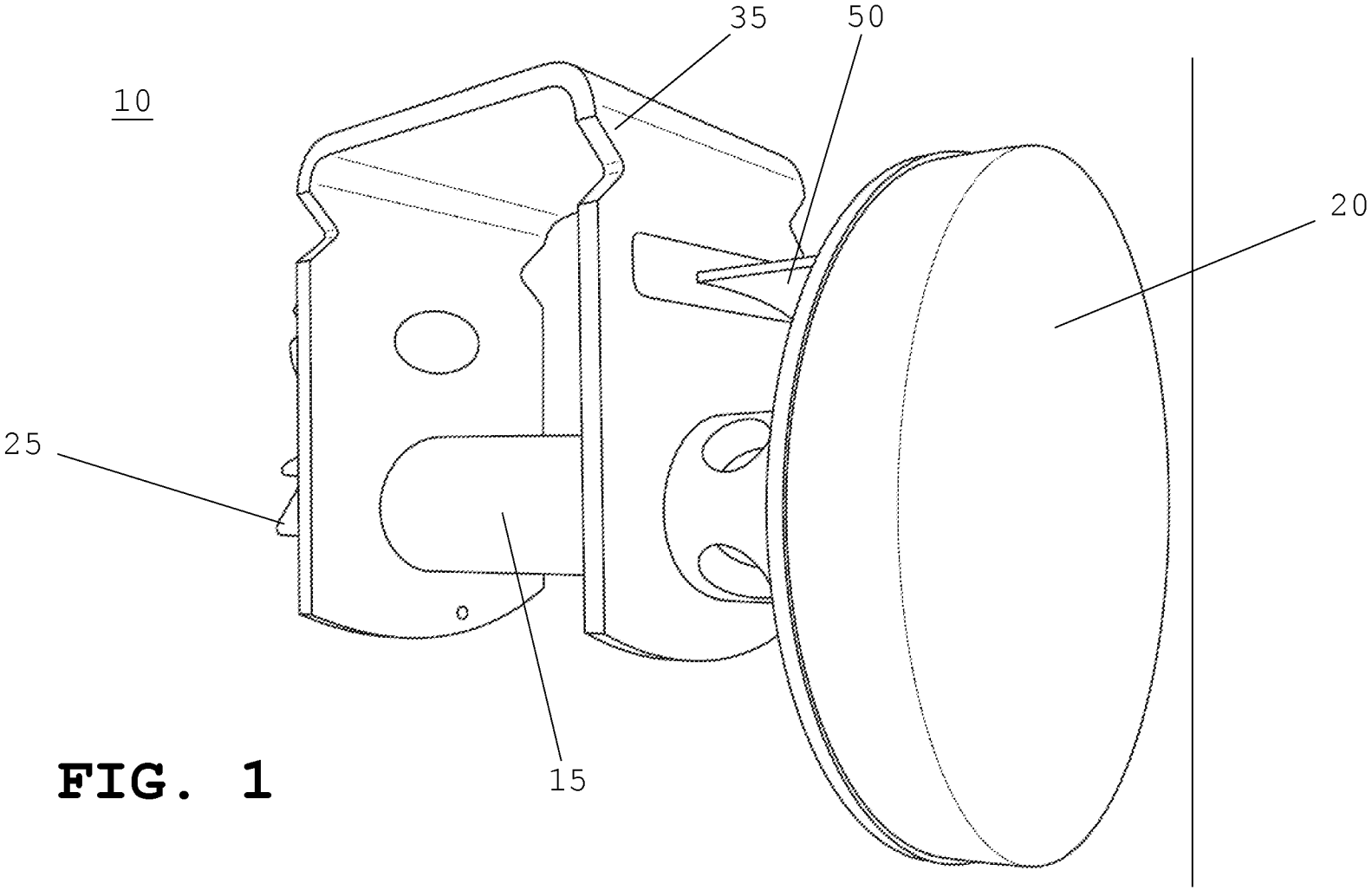
FIG. 1 is a perspective view of an improved winch in accordance with an embodiment of the present disclosure.
Figure 2:
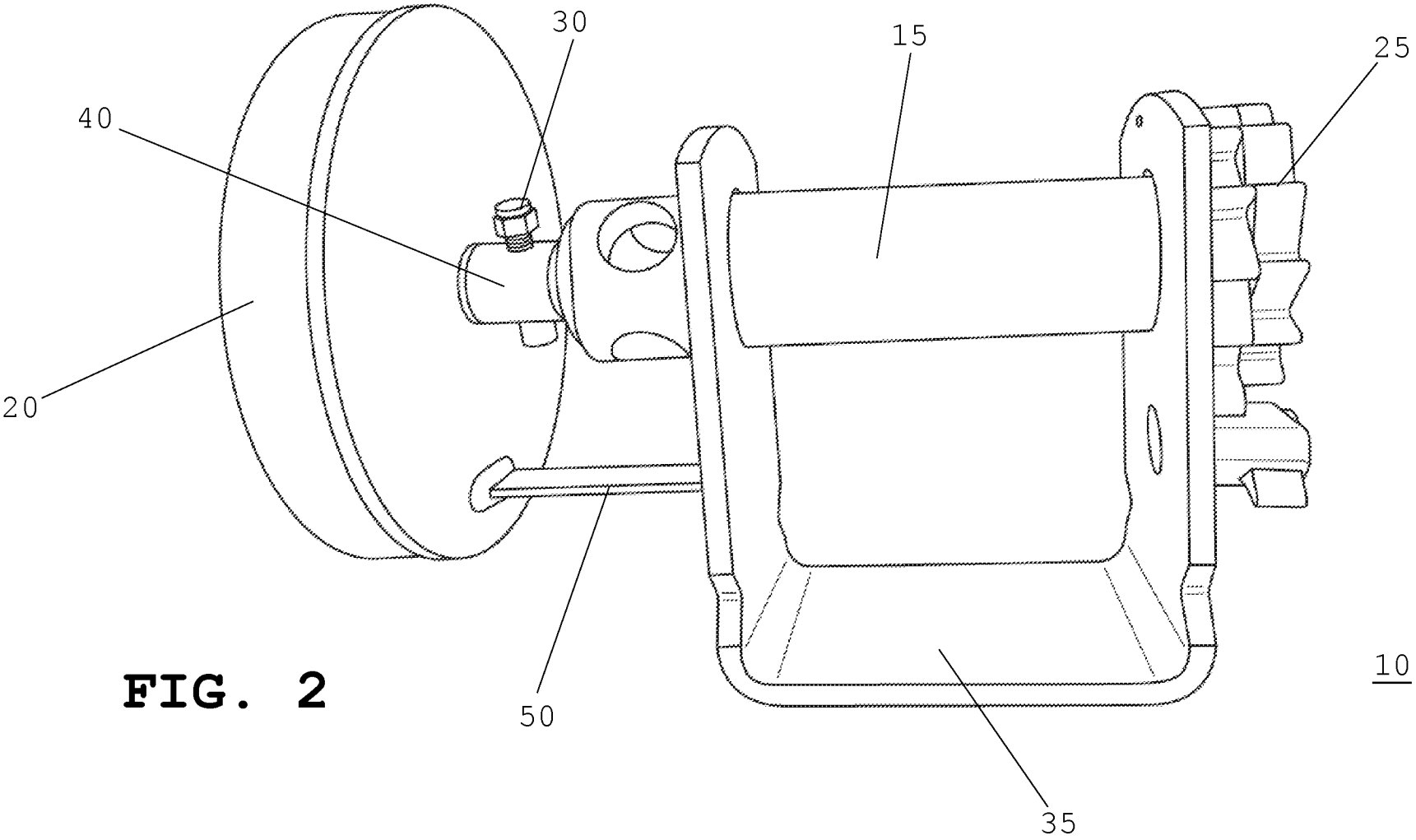
FIG. 2 is another perspective view of the improved winch of FIG. 1 according to an embodiment of the present disclosure.
Figure 3:
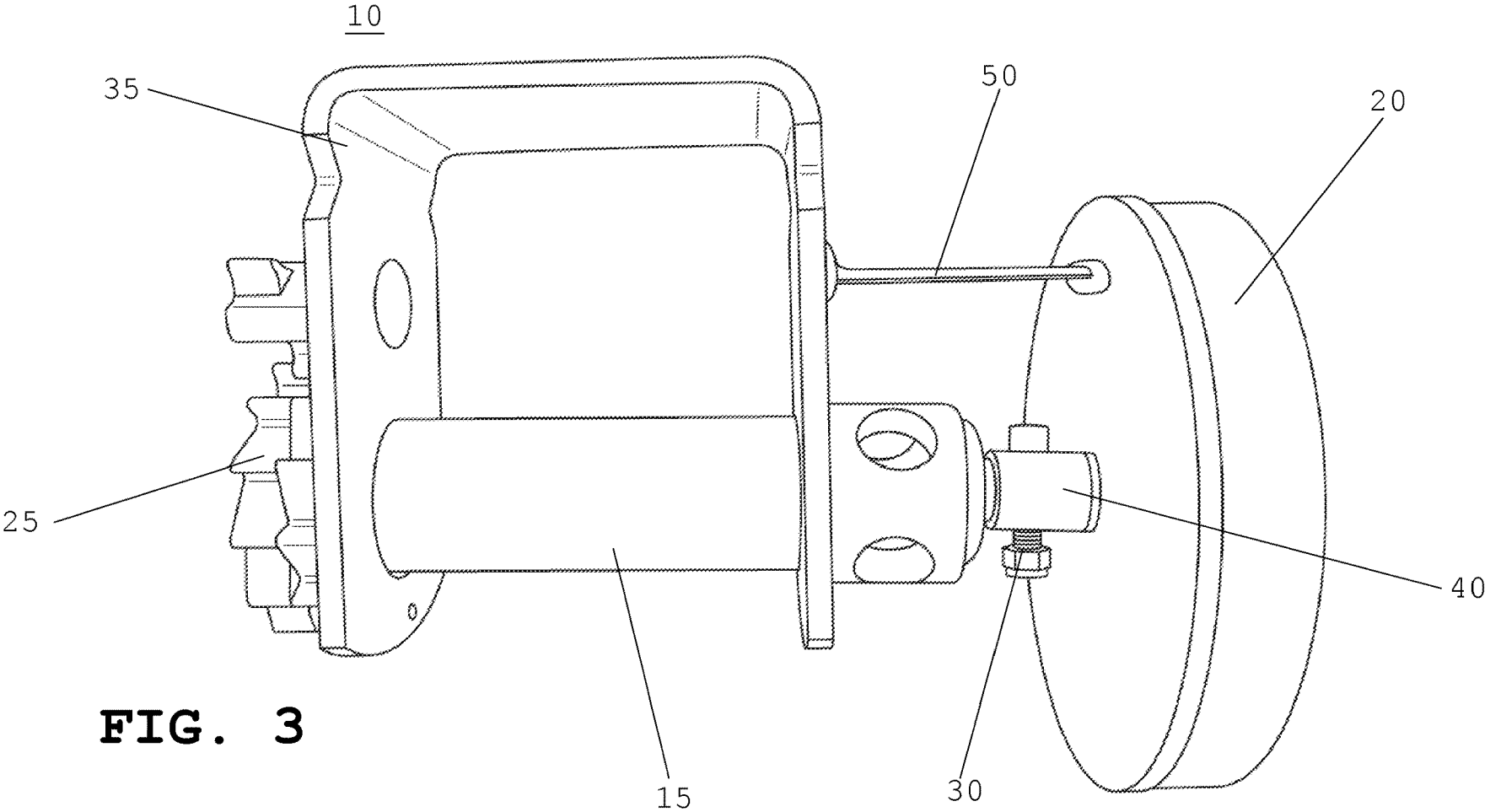
FIG. 3 is another perspective view of the improved winch of FIG. 1 according to an embodiment of the present disclosure.

With reference to FIGS. 1, 2 and 3 and according to an embodiment of the present disclosure, an improved winch 10 is shown preferably comprising a winding member 15, a recoiling mechanism 20, a locking gear 25 and a bolt 30. The winding member 15 is generally cylindrical with a slit (not shown) longitudinally through its axis to receive and wind a strap (not shown). The winding member 15 is further comprised of a U-shaped bracket 35 to be mounted on a surface of a vehicle or other suitable place known in the art. The winding member 15 terminates in a connector (not shown), which is fitted within an adapter 40 of the recoiling mechanism 20. A bolt 30 is shown, removably secured through both of the adapter 40 and the connector (not shown) through an aperture (not shown). When the bolt 30 is secured within both of the adapter 40 and the connector (not shown) and the strap (not shown) is installed on the winch 10, pulling on the strap to hook into an object rotates the winding member 15, which correspondingly rotates a coil (not shown) of the recoiling mechanism 20 to a biased position. When the bolt 30 is removed, the adapter 40 is no longer engaged with the connector (not shown) such that winding the winding member does not correspondingly wind the coil (not shown) of the recoiling mechanism 20. As shown, the winch 10 is further comprise of a support member 50. Support member 50 allows to keep recoiling mechanism 20 on level with bracket 35. Support member 50 further provides the ability of recoiling mechanism 20 to coil and recoil since otherwise it would spin if support member 50 was present.

Figure 4:
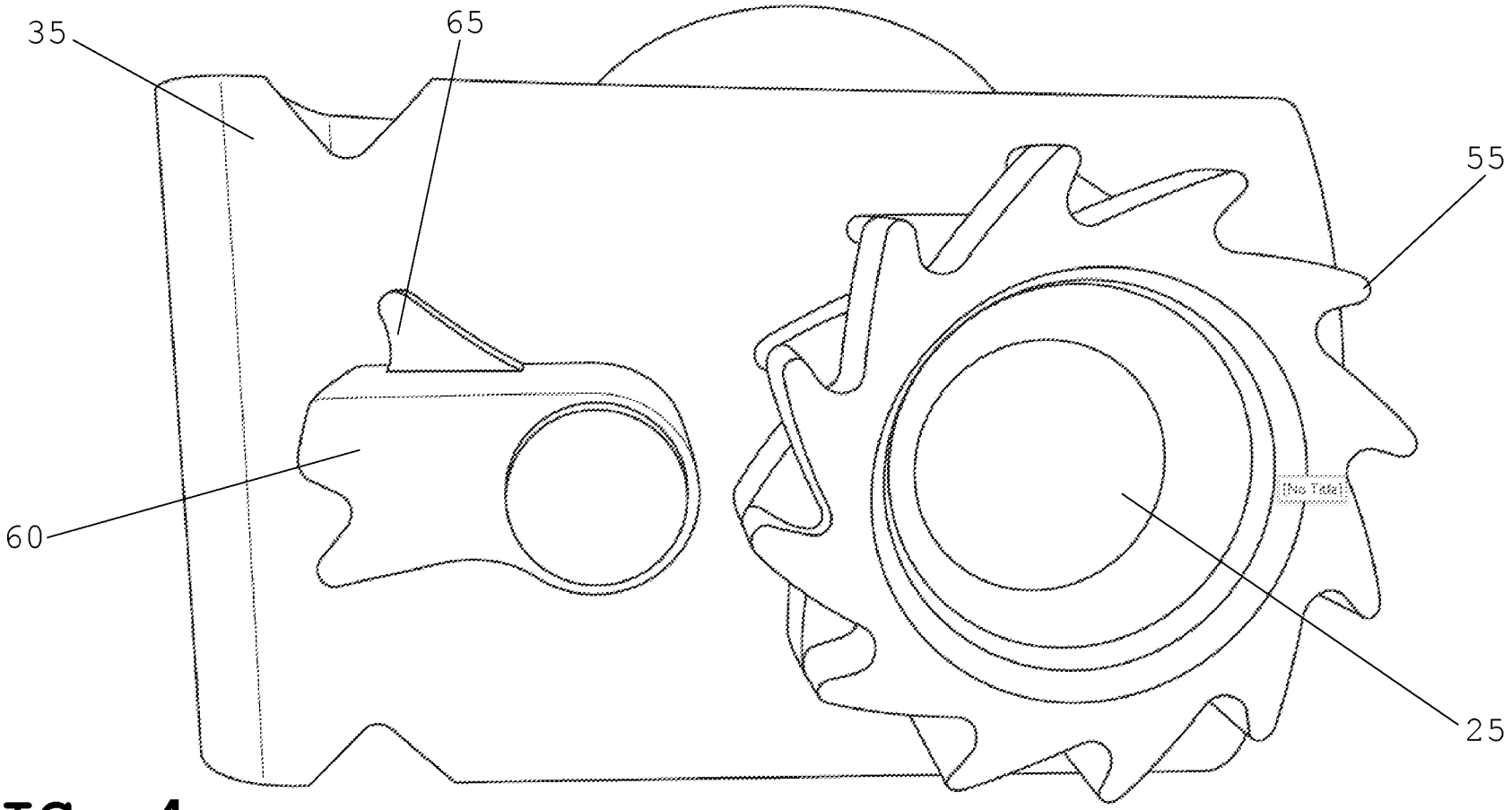
FIG. 4 is a side view of a locking gear and pin of the improved winch of FIG. 1, according to an embodiment of the present disclosure.

With reference to FIG. 4 and according to an embodiment of the present disclosure, the locking gear 25 is shown in greater detail secured to a first side of the bracket 35. The locking gear 25 has a plurality of teeth 55 to engage a pin 60 having a notch 65 as known in the art to prevent rotation of the locking gear 25. The pin 60 rotatable about an axis to lock and unlock the locking gear 25.

Figure 5:
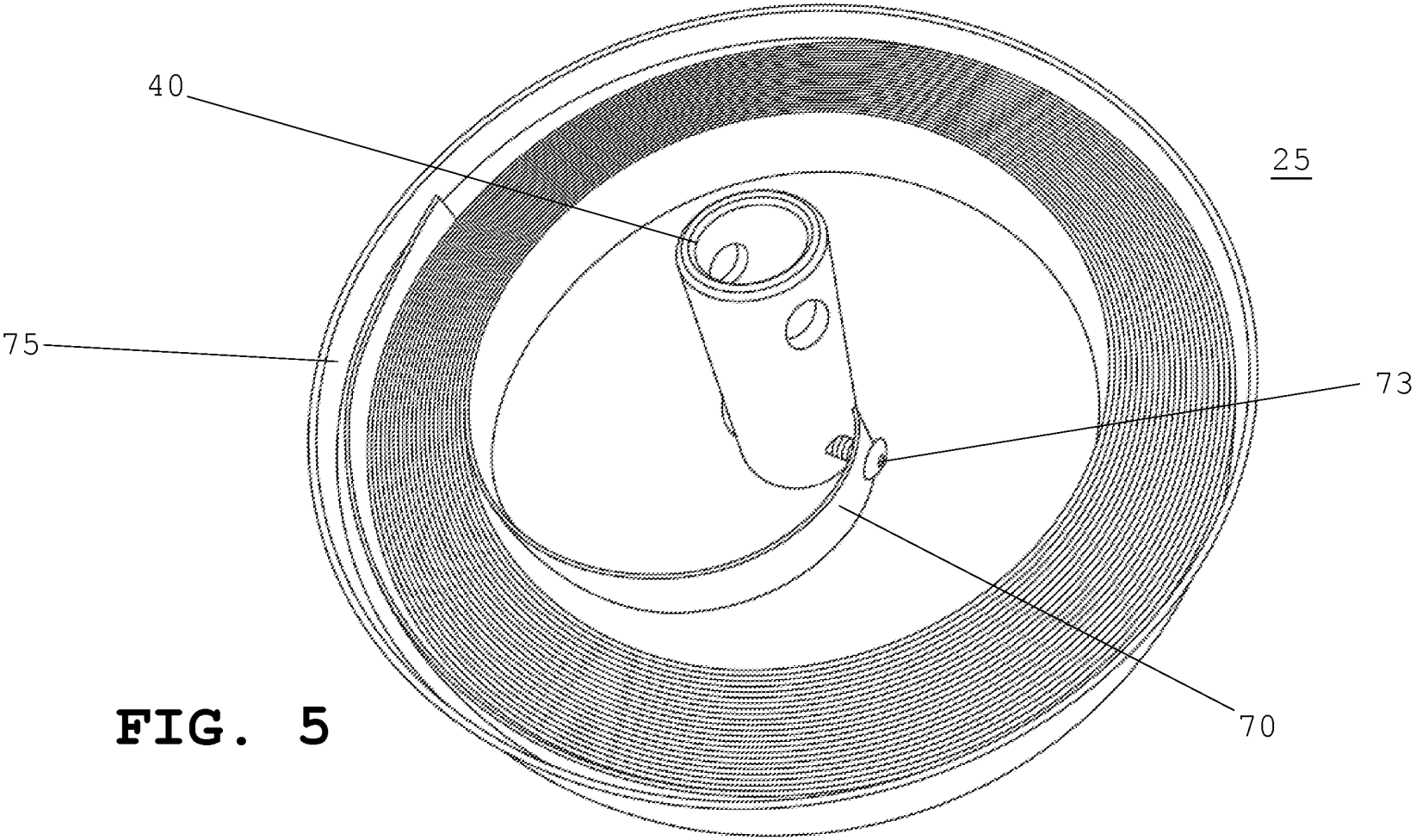
FIG. 5 is a perspective view of a recoiling mechanism of the improved winch of FIG. 1, according to an embodiment of the present disclosure.
Figure 6:
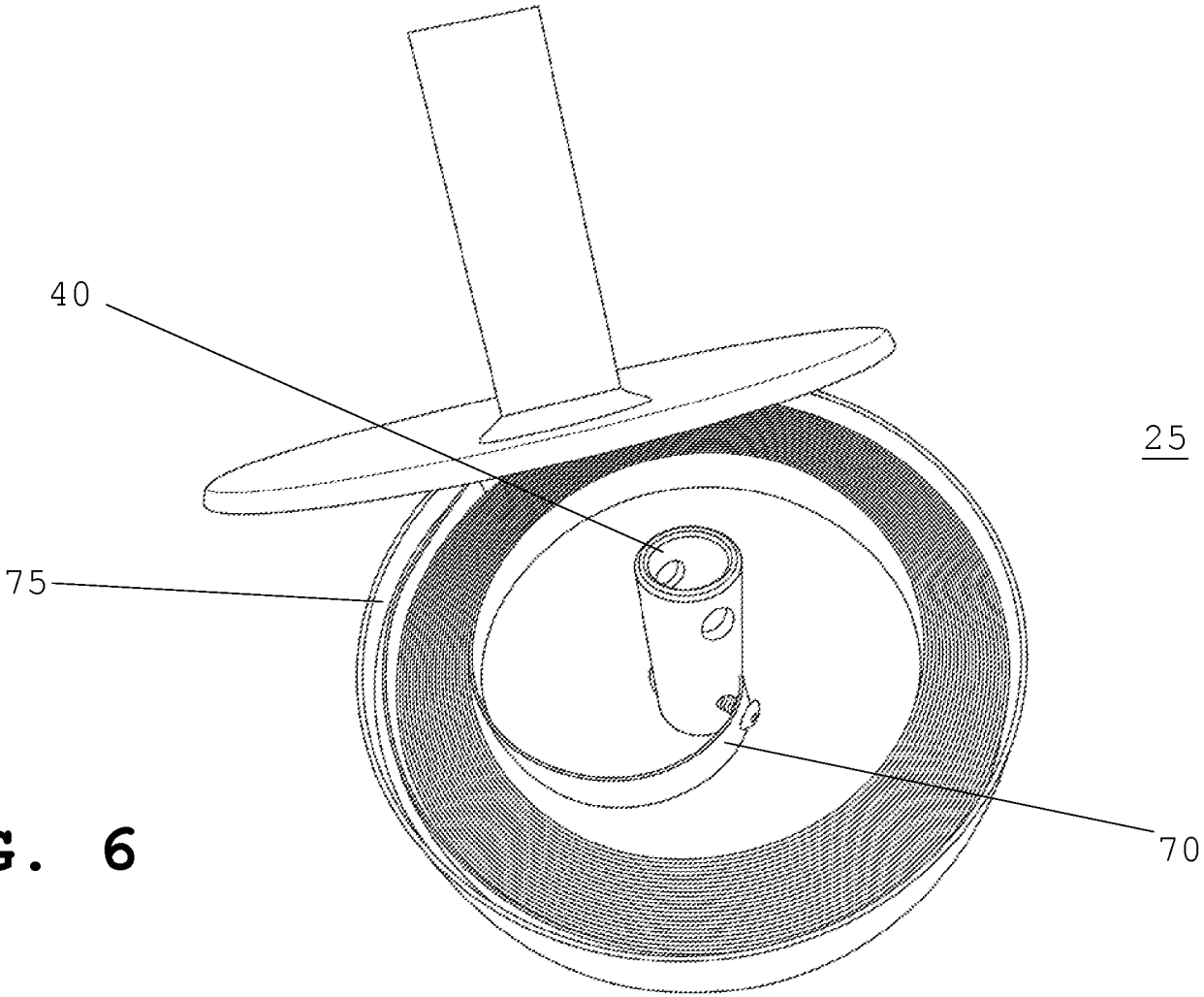
FIG. 6 is a perspective view of the recoiling mechanism and outer cover of the improved winch of FIG. 1, according to an embodiment of the present disclosure.
Figure 7:
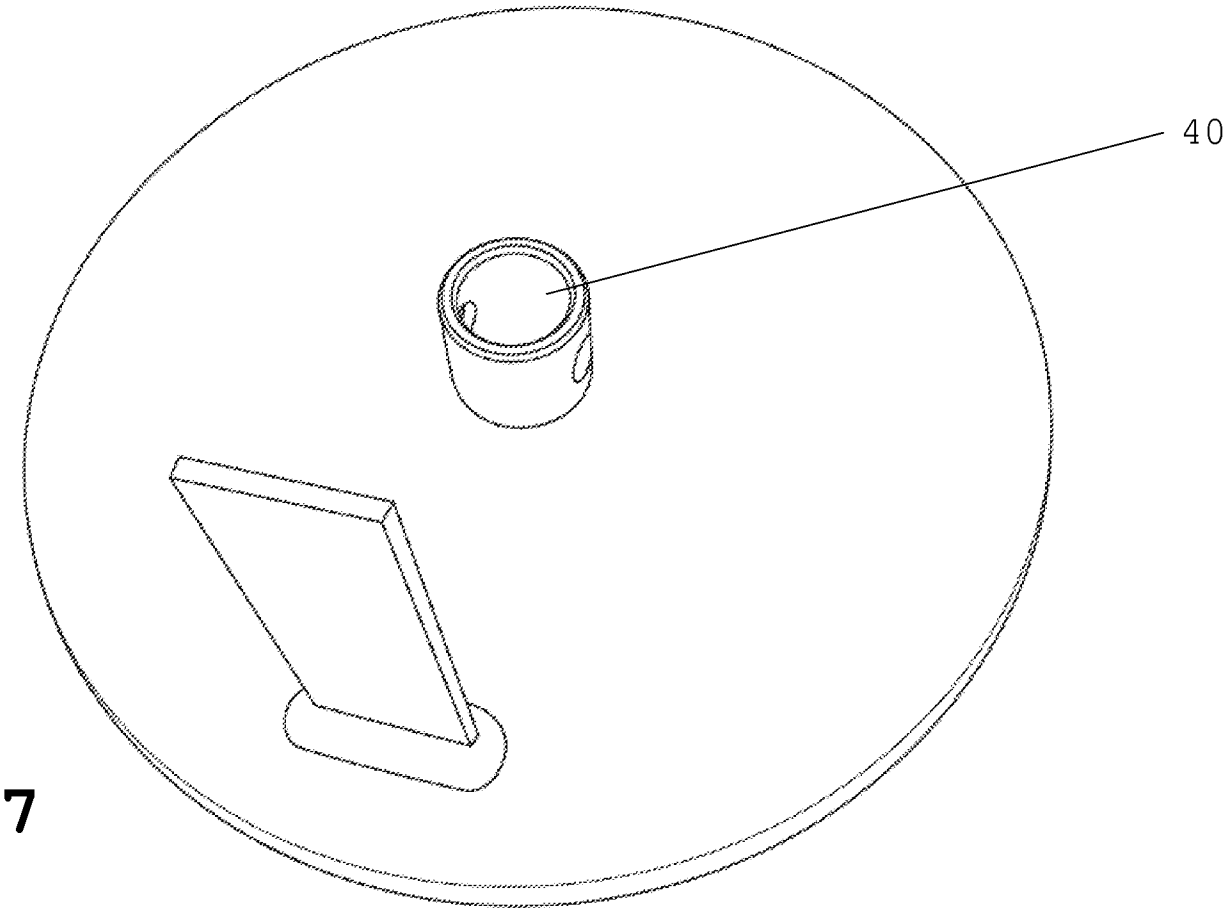
FIG. 7 is a perspective view of the outer cover of the improved winch of FIG. 1, according to an embodiment of the present disclosure.

With reference to FIGS. 5 and 6 and according to an embodiment of the present disclosure, the recoiling mechanism 25 is shown in greater detail and preferably comprised of an adapter 40 and a coil 70 attached and secured at one end to the adapter 40. As shown, the coil 70 is secured to the adapter 40 by way of screw 73 but may be secured thereto by other means known the art. In the position shown in FIGS. 5 and 6, the coil 70 is at rest, coiled around itself and proximate an inner edge 75 of the recoiling mechanism 25. The coil 70 is made of durable material and configured in such a way that when wound around the adapter 40, it will naturally bias the adapter 40 to rotate in the opposite direction from which it was wound. In other words, when the adapter 40 is rotated counterclockwise, the coil 70 is wound around and proximate to the adapter 40. The more the adapter 40 is rotated counterclockwise, the stronger the force acting on the adapter 40 from the coil 70 to bias it clockwise.

With reference to FIGS. 2 and 5, the initial setup and operation of the winch 10 will be described. In a first step, the bolt 30 is removed, which allows for the winding member 15 to be rotatable independently from the adapter 40. In a second step, the locking gear 25 is put in an unlocked position, allowing the winding member 15 to rotate freely both clockwise and counterclockwise. In a third step, a strap (not shown) is then inserted into and wound around the winding member 15 until the strap is fully wound. In a fourth step, the bolt 30 is then reinserted into the adapter 40 and the connector (not shown), and the locking gear 25 is moved back to the locked position. In a further step, the strap is then pulled out for about 3 meters and fed over itself (wound back) twice and the winch 10 is then ready to use. In a first operational step, pulling on the strap now engages the connector (not shown), which engages and rotates the adapter 40 through the bolt 30. The coil 70, which is in its original unbiased position at rest as shown in FIG. 5, is correspondingly rotated counterclockwise to a biased position that is not at rest, wound in proximity to the adapter 40. Meanwhile, the locking gear 25 is in a locked position, allowing unwinding of the strap but not allowing the strap to wind back. At this moment, the strap can be attached to an object and will remain taut. In a second step, by then releasing and unlocking the locking gear 25, the coil 70 rotates clockwise to return to its original, unbiased position at rest, which in turn rotates the adapter 40 and connector (not shown) and thus the winding member 15 and strap. Advantageously, this allows for easy recoiling of the strap when the strap is no longer in use, which is not possible in the prior art and requires manual winding.

Many modifications of the embodiments described herein as well as other embodiments may be evident to a person skilled in the art having the benefit of the teachings presented in the foregoing description and associated drawings. It is understood that these modifications and additional embodiments are captured within the scope of the contemplated disclosure which is not to be limited to the specific embodiment disclosed.

I claim:

1. A winch comprising:

a winding member to wind a strap, the winding member having a bracket and terminating in a connector;

a recoiling mechanism connected to the winding member, the recoiling mechanism further comprising:

an adapter to operatively engage the connector; and, a coil secured to the adapter and coiled within the recoiling mechanism;

a locking gear connected to the winding member to lock the recoiling mechanism when the coil is in a biased position; and, a bolt removably secured through the adapter and the connector, wherein unwinding the strap from the winding member correspondingly rotates the coil to the biased position when the bolt is secured through the adapter and the connector.

* * * * *